US005388289A

United States Patent [19]

Casperson

[11] Patent Number: 5,388,289

[45] Date of Patent: Feb. 14, 1995

[54] COMBINATION WHEELCHAIR AND LIFT

[76] Inventor: Donald L. Casperson, 4243 13.75 Rd., Escanaba, Mich. 49829

[21] Appl. No.: 121,427

[22] Filed: Sep. 16, 1993

[51] Int. Cl.[6] ..... A61G 7/10

[52] U.S. Cl. ..... 5/861; 5/81.1; 5/83.1; 280/250.1; 280/304.1

[58] Field of Search ..... 5/81.1, 83.1, 86.1, 5/87.1; 280/250.1, 304.1; 414/921

[56] References Cited

U.S. PATENT DOCUMENTS

| | | | |
|---|---|---|---|
| 3,877,421 | 4/1975 | Brown . | |
| 3,981,484 | 9/1976 | James | 5/81.1 X |
| 4,010,499 | 3/1977 | Davis et al. | 5/81.1 |
| 4,144,713 | 3/1979 | Clark et al. . | |
| 4,193,147 | 3/1980 | Fischer . | |
| 4,432,359 | 9/1984 | James | 5/81.1 X |
| 4,999,862 | 3/1991 | Hefty . | |
| 5,153,953 | 10/1992 | Sumrall . | |
| 5,165,123 | 11/1992 | Colpron | 5/86.1 X |
| 5,188,383 | 2/1993 | Thompson . | |
| 5,333,333 | 8/1994 | Mah | 280/250.1 X |

FOREIGN PATENT DOCUMENTS

| | | |
|---|---|---|
| 775907 | 1/1935 | France . |
| 2179625 | 3/1987 | United Kingdom . |

OTHER PUBLICATIONS

Manufacturer's Promotional Literature: Invacare Corp, Elyria, Ohio, 2 pp. Featuring 9800 Series Products, 1989.

Manufacturer's Promotional Literature: Century, 1 p. Featuring Model C3 (undated).

*Primary Examiner*—Michael F. Trettel

*Attorney, Agent, or Firm*—Richard C. Litman

[57] ABSTRACT

A knockdown, portable combination wheelchair and lift which is readily assembled and disassembled, thereby enabling convenient stowage and transport when not in use. The invention breaks down into a base, a chair, a footrest for the chair, and a boom having a sling. The base is U-shaped, having front casters and rear wheels. A mast projects vertically from the base, and can be folded down, parallel with the legs of the U, during disassembly. The chair mounts on the mast, and folds for compact stowage. A boom having winch, chain, and sling is supported by telescoping fit into the mast, and can raise and lower a passenger seated on the sling. This enables the chair portion to be removed, the lift now being able to penetrate a motor vehicle, and deposit the passenger therein. Both the boom and the chair are removable from the remaining components, so that the invention is selectively configured alternatively as a wheelchair or a lift. The major components interfit, as by peg and hole construction, and fasteners are manual, so that the invention is assembled and disassembled entirely by hand. The four major components are sufficiently flat to fit, when disassembled, in the trunk of most automobiles. The wheelchair includes fenders for guiding the same past obstructions, such as a flange or lip formed on stairs, when the wheelchair is pulled up a flight of stairs.

14 Claims, 4 Drawing Sheets 10
52
54
58
20
18
24
46
60
66
64
62
56
48
40
64
64
42
50
22
12
66
70
76
74
38
98
36
72
68
82
32
72
72
72
86
34
78
94
80
92
84
14
96
90
88
100
26
28
30
16

COMBINATION WHEELCHAIR AND LIFT

BACKGROUND OF THE INVENTION

1. Field of the Invention

The present invention relates to a wheelchair combined with a lift or hoist.

2. Description of the Prior Art

Many devices for lifting and transporting nonambulatory persons have been devised in the past. U.S. Pat. No. 4,193,147, issued to Edwin L. Fischer on Mar. 18, 1980, discloses a wheelchair having an outrigger and sling for lifting a person from the chair. The wheelchair also has armrests which are removable from the wheelchair by pulling the same from supporting sockets; the outrigger is similarly removable.

A hoist attachable to any standard wheelchair is shown in U.S. Pat. No. 4,999,862, issued to James C. Hefty on Mar. 19, 1991. The hoist includes means to suspend a sling therefrom. The wheelchair is disassembled to a certain degree to enable a hoist base to be assembled thereto at the axle. The outrigger is then welded, or otherwise suitably and solidly attached, to the hoist base.

An invalid lift system is shown in U.K. Pat. Document No. 2,179,625, dated Mar. 11, 1987. The invention shown therein includes a wheelchair frame having a removable seat. The seat is removable from the frame, and is suspended from a cooperating stanchion. Apart from being configured to support the wheelchair seat, the frame and stanchion are separate and unrelated to one another.

A number of devices suitable for transferring an invalid, as from a wheelchair to a bed, have been proposed in the prior art. These devices generally include a boom mounted on a vertical mast, which in turn is supported on a U-shaped base having casters or wheels. U.S. Pat. No. 5,153,953, issued to Joe L. Sumrall, exemplary of such devices, is manually disassembled due to peg and hole construction, components being held together by gravity.

Further examples of transfer devices include U.S. Pat. Nos. 3,877,421, issued to Cicero C. Brown on Apr. 15, 1975 and 4,144,713, issued to Raymond Clark et al.; and French Pat. Document No. 775,907, dated Jan. 12, 1935.

A user-collapsible wheelchair is disclosed in U.S. Pat. No. 5,188,383, issued to Josephine M. Thompson on Feb. 23, 1993. The wheelchair folds in accordion fashion at pivot joints, rather than disassembling into separate components.

None of the above inventions and patents, taken either singly or in combination, is seen to describe the instant invention as claimed.

SUMMARY OF THE INVENTION

The combination of wheelchair and lift of the present invention improves portability over prior art devices of the same purpose. This requires, among other attributes, that the device be reconfigurable to assume compact dimensions, and that the operation to accomplish this be readily performed. The present invention therefore is broken down by disassembly into four major, readily separable components which mutually interfit, or attach by manually operated fasteners. Moreover, two of the four components fold to attain still more compact configuration.

A U-shaped base having rolling supports in the form of two wheels and two casters is the first of the four components, and includes a vertical stanchion, or mast. Two components attach to the mast. The first is a foldable chair assembly, and the second is a boom. The chair includes a receptacle which engages a projection formed on the mast, and is held thereon by gravity. Receptacle and projection cooperate to maintain the chair solidly in fixed position, preventing rocking and other unstable movement. The boom, which includes a winch, a chain, and a sling, is inserted in peg and socket fashion into the mast, and is also retained by gravity. The fit between peg and socket is configured to enable only axial motion therebetween, the boom being held securely to the mast, and avoiding play or unstable motion. Finally, a footrest is attached to the chair.

The assembled invention is wheeled about as a conventional wheelchair, when the boom and sling are removed. The chair adjusts to vary inclination, to suit the passenger. The mast includes maneuvering handles to aid a person pushing the wheelchair.

When it is desired to transfer the passenger, as from the wheelchair to a bed or motor vehicle seat, the boom and sling are installed. The passenger maneuvers into a seated position on the sling, the latter remaining supported on the chair portion of the combination wheelchair. The winch and boom are then employed to elevate the passenger.

When the sling and passenger are sufficiently clear, the chair can be removed. The invention, now configured as a wheeled lift, can then be maneuvered to position the passenger into an automobile. This is enabled since the U-shaped base fits below the chassis of most sedans or other passenger vehicles, and the boom is simultaneously maneuverable into the vehicle interior.

The sling is lowered onto a vehicle seat, the passenger seated thereon, so as to be readily transferred again when the vehicle reaches its destination. The invention is disassembled, and is easily stowed in the trunk of a sedan.

Stowage is aided by the configuration of the components. The base and seat are configured to retain two dimensions from the operative configuration, but to reduce drastically a third dimension for stowage. In the case of the base, this is accomplished by folding the mast down to become parallel to the legs of the U formed by the base. A slip bar keys the mast to prevent collapse when lifting a passenger, and is removed to enable folding. Similarly, the chair folds to assume a more planar configuration. In this manner, one dimension of the base and chair is reduced to about a third of its operative magnitude. In this sense, components will be referred to as being flattened or flat, understanding that the term "flat" is relative to the magnitude of the operative dimension. The footrest and the boom are already nearly flat, and need not be reduced in the manner of the base and chair.

The wheelchair and lift has fenders to enable it to be pulled up a flight of stairs without the wheels snagging under a flange or lip which is frequently formed in wooden, residential stairs.

The wheelchair and lift employs, where advantageous, both peg and socket construction, and manual fasteners, such as pins inserted into aligned holes and secured in place by friction or tension fasteners, such as resilient clips. Fasteners are manual in the sense that they are designed to be installed and removed by hand. To accomplish this, the pin or fastener includes an enlarged head, an integral ring, or other members to enable grasping and maneuvering by hand rather than by a tool. One example is the use of wingnuts, rather than hexagonal nuts, the latter requiring a wrench to turn.

In summary, the present invention combines three important characteristics to produce a portable, knock-down combination wheelchair and lift. These are unfastened peg and socket connection between chair and mast, and between boom and mast; manual fasteners; and major components having the ability to fold to a flat configuration.

Accordingly, it is a principal object of the invention to provide a combination wheelchair and lift which is selectively configured as one or the other.

It is another object of the invention to provide a combination wheelchair and lift which is readily and manually reconfigured as wheelchair or lift.

An additional object of the invention is to provide a combination wheelchair and lift which is disassembled into flat components.

It is a further object of the invention to provide manual fastening and attachment of the components of the combination wheelchair and lift which enable the assembled wheelchair and lift to perform as intended, while enabling ready assembly and disassembly.

Another object of the invention is to provide a combination wheelchair and lift which can be pulled up a flight of stairs without snagging on a lip or flange formed in the stairs.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
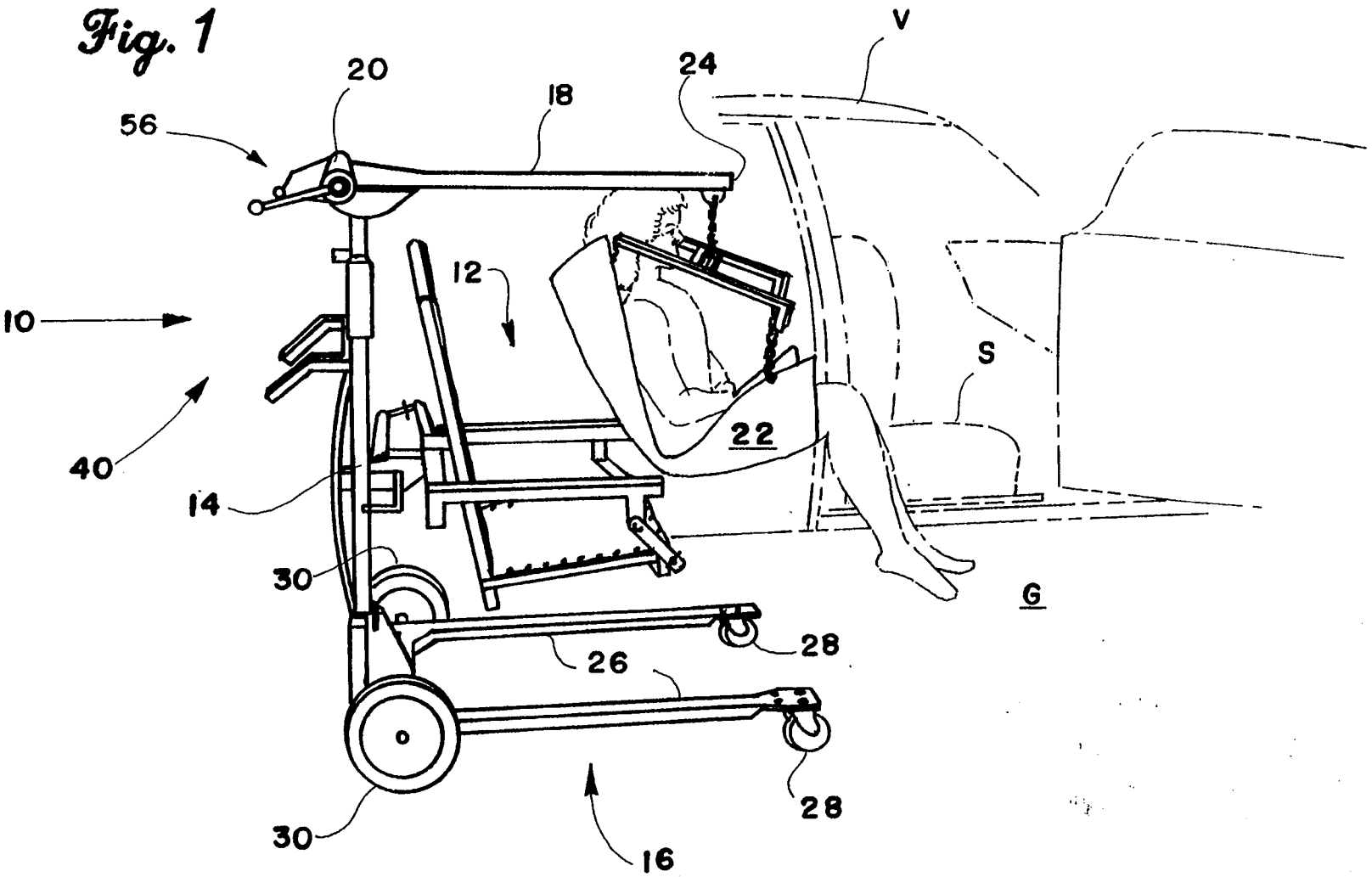
FIG. 1 is an environmental, perspective view of the invention.

Turning now to FIG. 1 of the drawings, the combination wheelchair and lift 10 comprises a chair 12 supported on a vertical mast 14 secured to a U-shaped base 16. Chair 12 enables the combination wheelchair and lift 10 to transport a passenger P about in the manner of a conventional wheelchair. Mast 14 also supports a boom 18 and a winch 20, from which winch 20 a sling 22 is suspended, preferably toward boom distal end 24. Passenger P is transferred to a bed, vehicle seat S, or other conveyance, bed, or the like, using boom 18 and sling 22.

Base 16 includes two legs 26 each having a caster 28 mounted fore and a wheel 30 mounted aft. Legs 26,26 are sufficiently limited in their projection above floor or ground surface G such that base 16 can be maneuvered beneath the chassis of a motor vehicle. The combination of wheels 30,30 and casters 28,28 enables combination wheelchair and lift 10 to be maneuvered so that legs 26,26 of U-shaped base 16 extend beneath the chassis of vehicle V, and boom 18 is lowered so as to be able to penetrate inside vehicle V, and successfully deposit passenger P directly onto vehicle seat S.

Figure 2:
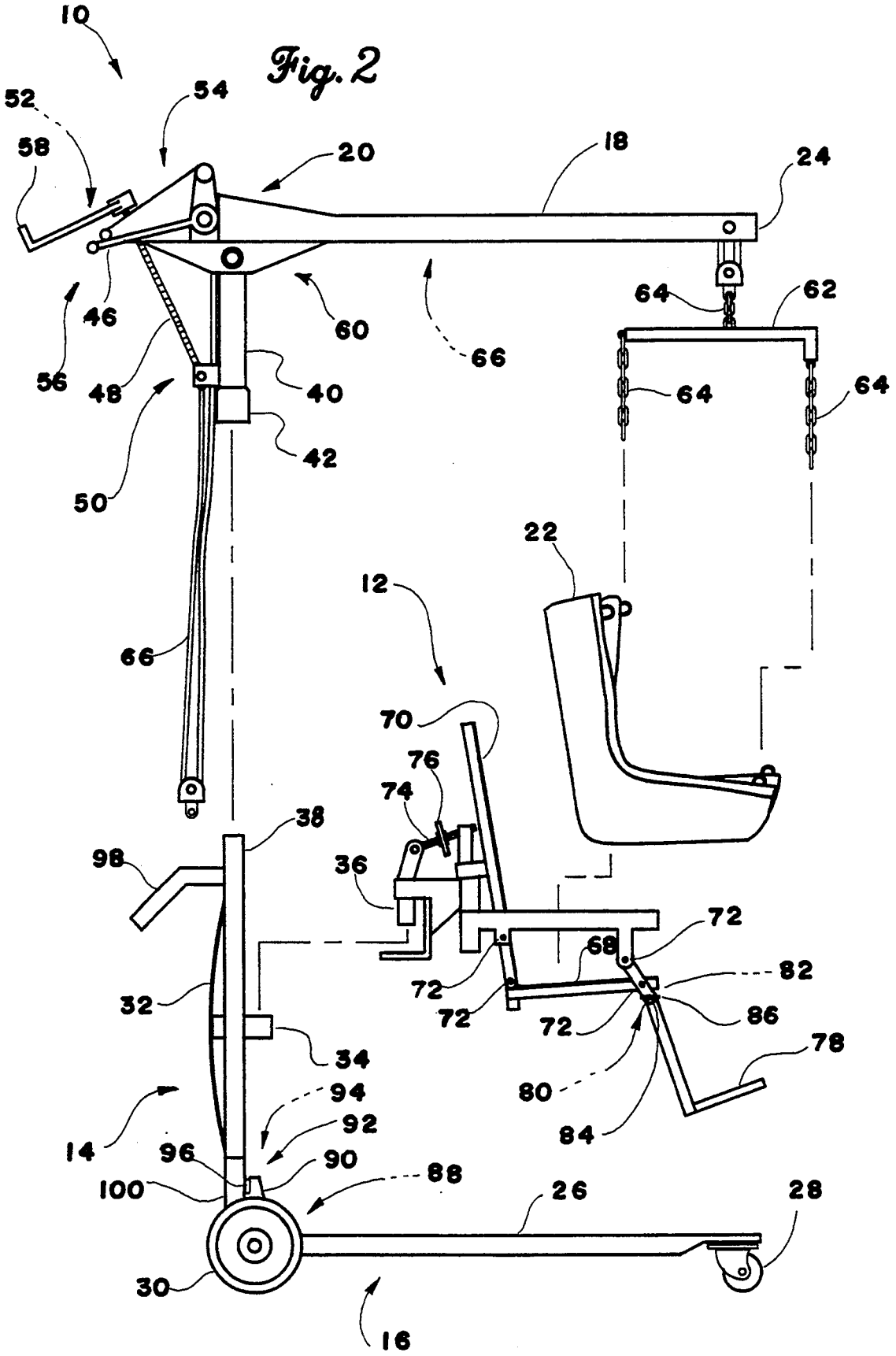
FIG. 2 is an exploded, side elevational view of the invention, showing the major components in relative operative configuration.

Construction of combination wheelchair and lift 10 is described in greater detail, with reference to FIG. 2. Mast 14 preferably includes a reinforcing member 32, and has a receptacle 34 attached thereto for receiving a cooperating projection 36 formed on chair 12. When projection 36 is inserted into receptacle 34, chair 12 is retained thereon by gravity.

The top of mast 14 forms a peg 38 for connection to boom 18. Boom 18 includes a vertical portion 40 including a socket 42, and socket 42 is placed over peg 38. Fit of peg 38 within socket 42 is sufficiently tight as to constrain only axial motion therebetween. Again, gravity holds boom 18 to mast 14.

Boom 18 supports winch 20, which has associated handle 46 for winding the same. Boom 18 is raised and lowered by a screw 48, which is anchored at 50 to vertical portion 40, and at 52 to an extension 54 formed at boom proximal end 56. Screw 48 is operated by handle 58. A pivot joint 60 is formed in vertical portion 40, thereby enabling boom 18 to incline more or less in response to turning screw 48.

Sling 22 is attached by a hanger 62 and chains 64 or the like to boom 18, Winch 20 winds up a winch chain 66 or similar item to raise and lower hanger 62. Preferably, sling 22 is dimensioned and configured to cooperate with chair 12, so it is nested comfortably and inconspicuously thereon when a passenger is seated in chair 12, Chair 12 includes a seat 68 and a seatback 70, mutually connected by pivot joints 72. Inclination of seatback 70 is adjusted by screw 74, which preferably includes an adjustment wheel 76 to facilitate turning screw 74. A footrest 78 is detachably attached to chair 12, Footrest 78 includes a rod 80 insertable into a hole 82 formed in a member 84 secured to chair 12, A winged screw 86 secures rod 80 in hole 82.

It will be observed that chair 12 is constructed with many pivot joints 72, so that it folds into a flat configuration, when detached from mast 14. In like manner, U-shaped base 16 folds into a flatter configuration by the following arrangement. Mast 14 is hinged at axle 88, being pivotable thereabout. A tab 90 projecting from mast 14 has a slot 92 aligned with a second slot 94 formed on a solid or fixed portion of axle 88, fixed with respect to mast 14. A slip bar 96, when placed in aligned slots 92 and 94, locks mast 14 in a vertical position. Slip bar 96 is manually removed to release mast 14 for folding down.

Figure 3:
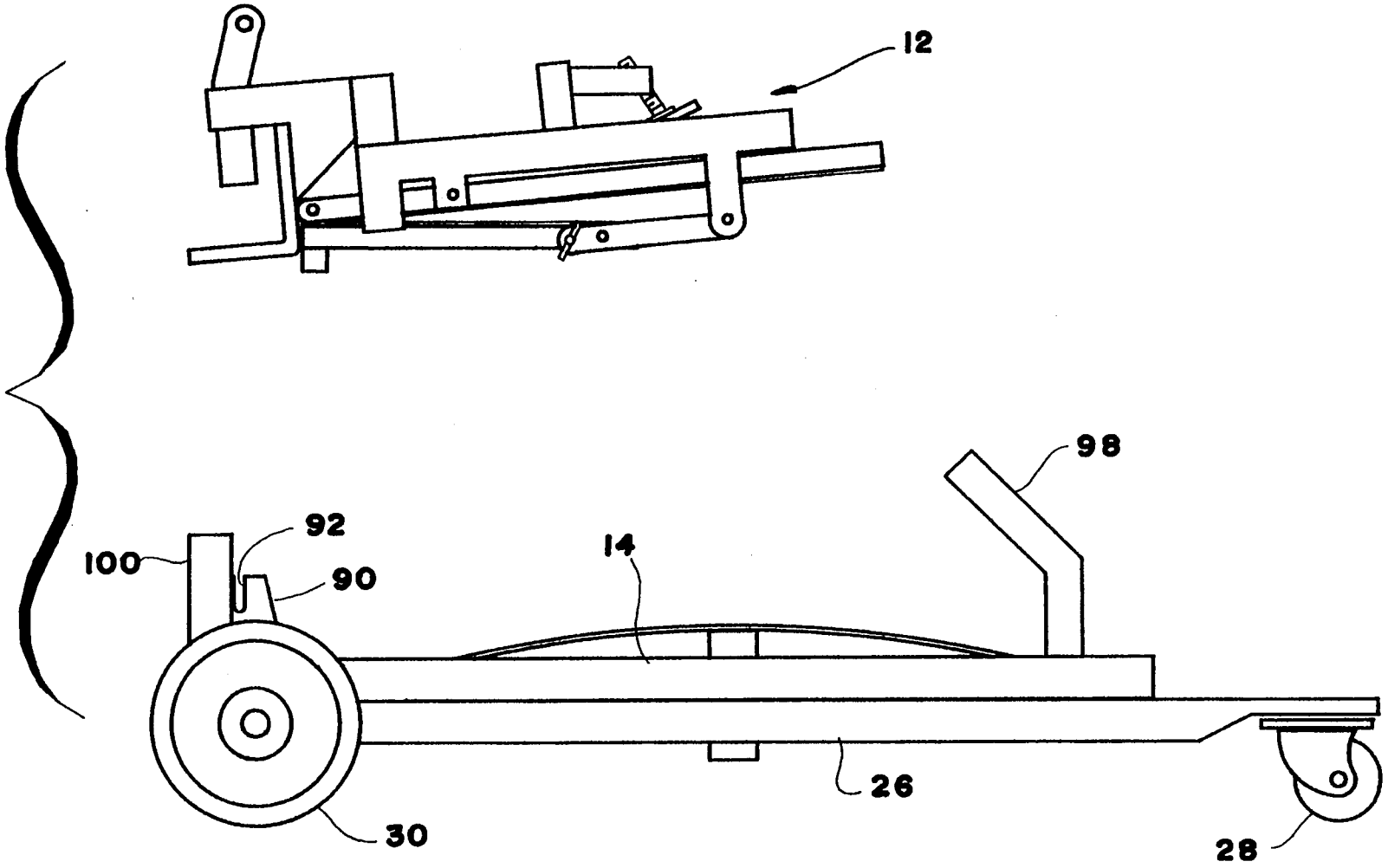
FIG. 3 is an exploded, side elevational view of two major components of the invention folded for stowage, drawn to enlarged scale.

The collapsed or folded condition of U-shaped base 16 and chair 12 are shown in FIG. 3. Both components fold to, roughly, a third of the volume occupied thereby in their respective operative configurations.

Figure 4:
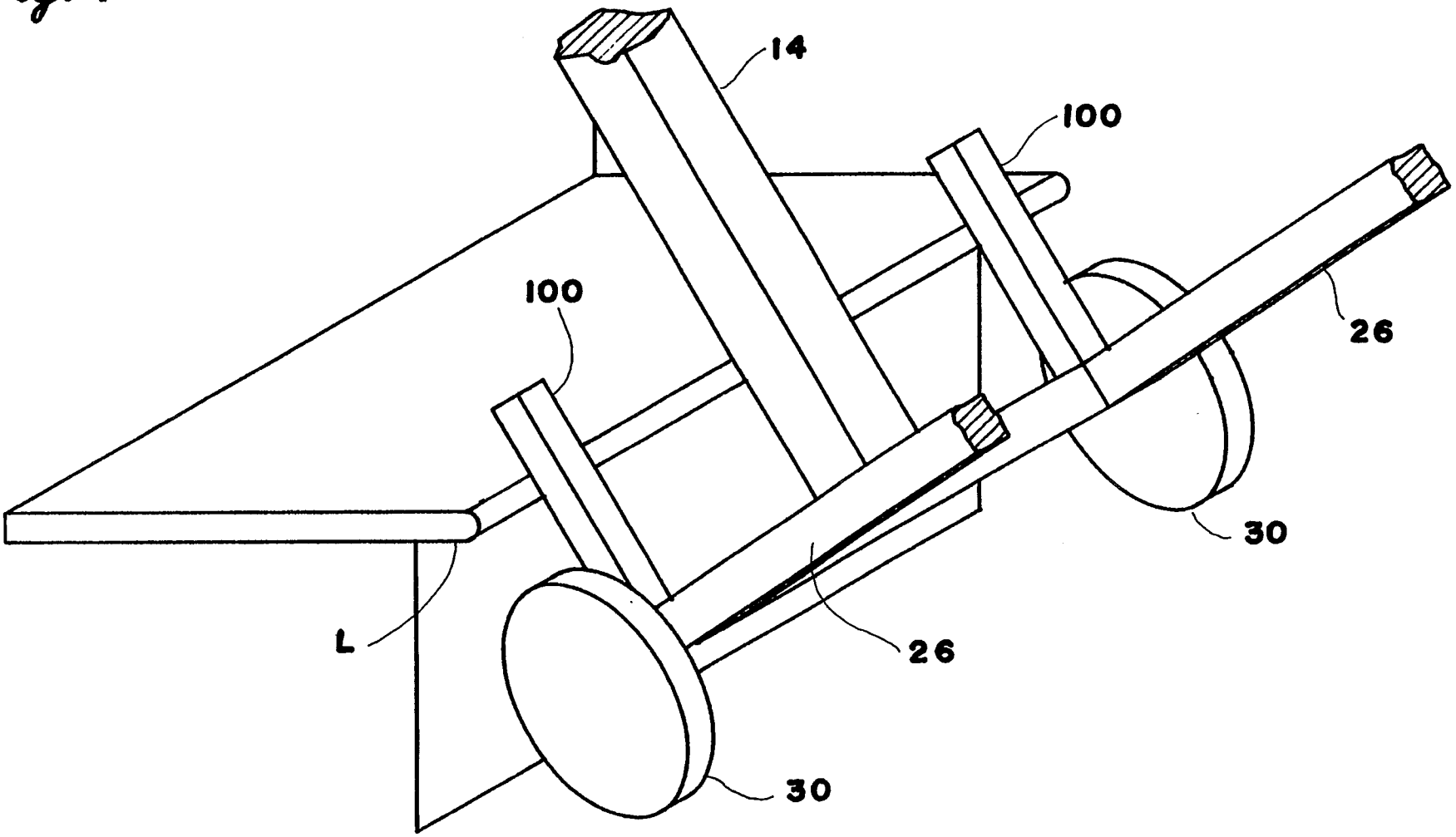
FIG. 4 is an environmental, broken away detail view of the invention, illustrating how fenders enable negotiating of stairs.

Maneuvering handles 98, for maneuvering combination wheelchair and lift 10 by a person pushing the same, and a linear frame channel project upwardly from folded U-shaped base 16. Projecting frame channels have a special purpose, and are referred to as fenders 100, explanation of which is best illustrated with reference to FIG. 4. Combination wheelchair and lift 10 must occasionally be pulled up a flight of stairs in a user's residence. Residential stairs frequently include a flange or lip L, which could easily snag on or otherwise obstruct a wheel 30. Fenders 100 guide and lift combination wheelchair and lift 10 away from stair lips L, so that neither wheels 30,30 nor other parts interfere therewith. Combination wheelchair and lift 10 can therefore be pulled, with or without a passenger, up stairs without hazard of obstruction or interference with a stair lip L.

It is to be understood that the present invention is not limited to the sole embodiment described above, but encompasses any and all embodiments within the scope of the following claims.

I claim:

1. A knockdown, portable combination wheelchair and lift, comprising:

a base having at least one horizontal leg, a plurality of rolling supports attached to said base, enabling said base to be rolled along a horizontal environmental surface, a vertically disposed mast secured to said base, said mast having a hinge enabling said mast to be selectively folded down and disposed vertically, said hinge further including means constraining said mast, when disposed vertically, to remain so disposed;

a chair having a seat, a seatback having pivot joints pivotally attaching said seatback to said seat, means removably attaching said chair to said mast; and a boom having a distal end toward which is attached a sling, and a proximal end toward which is disposed means for readily attaching said boom to and detaching said boom from said mast.

2. The combination wheelchair and lift according to claim 1, further including a footrest having footrest attachment means for readily attaching said footrest to and detaching said footrest from said combination wheelchair and lift.

3. The combination wheelchair and lift according to claim 2, said footrest attachment means further comprising a rod and means defining a hole cooperatively receiving said rod, and means retaining said rod in said hole.

4. The wheelchair and lift according to claim 3, said means for readily attaching said boom to and detaching said boom from said mast further comprising pivot joint means for inclining said boom at a desired angle, with respect to said mast, a selected position thereby being attained, said pivot joint means including means maintaining said boom in said selected position.

5. The combination wheelchair and lift according to claim 1, said means removably attaching said chair portion to said mast comprising a projection and means defining a receptacle partially surrounding said projection.

6. The combination wheelchair and lift according to claim 1, said chair portion further including at least one armrest attached thereto, and means enabling said at least one armrest to fold to a collapsed position parallel to said seatback, when said chair portion is folded to a collapsed position.

7. The combination wheelchair and lift according to claim 1, said means for readily attaching said boom to and detaching said boom from said mast comprising a peg disposed upon one of said boom and said mast, and the other of said boom and said mast having means defining a socket cooperating with said peg such that said peg is constrained to move axially in and out of said socket, and gravity holds said boom to said mast.

8. The combination wheelchair and lift according to claim 1, said means for readily attaching said boom to and detaching said boom from said mast comprising pivot joint means for inclining said boom at a desired angle with respect to said mast, a selected position thereby being attained, said pivot joint means including means maintaining said boom in said selected position.

9. The combination wheelchair and lift according to claim 1, said boom further comprising a winch and chain for selectively raising and lowering said sling.

10. The combination wheelchair and lift according to claim 1, further having fender means for guiding said combination wheelchair and lift past environmental obstructions which would otherwise snag thereon, whereby said combination wheelchair and lift is able to be pulled up a flight of stairs.

11. A knockdown, portable combination wheelchair and lift, comprising:

a base having at least one horizontal leg, a plurality of rolling supports attached to said base, and enabling said base to be rolled along a horizontal environmental surface, a vertically projecting mast secured to said base, said mast having a hinge enabling said mast to be selectively folded down and disposed vertically, said hinge further including means constraining said mast, when disposed vertically, to remain so disposed;

a chair having a seat, a seatback having pivot joints pivotally attaching said seatback to said seat, means removably attaching said chair to said mast comprising a projection and means defining a receptacle partially surrounding said projection; and a boom having a distal end toward which is attached a sling and means suspending said sling therefrom, and a proximal end toward which is disposed means for readily attaching said boom to and detaching said boom from said mast, comprising pivot joint means for inclining said boom at a desired angle, with respect to said mast, a selected position thereby being attained, said pivot joint means including means maintaining said boom in said selected position, and a winch and chain for selectively raising and lowering said sling.

12. The combination wheelchair and lift according to claim 11, further including a footrest having footrest attachment means for readily attaching said footrest to and detaching said footrest from said chair, comprising a peg and a socket, and means retaining said peg in said socket.

13. The combination wheelchair and lift according to claim 11, further including at least one armrest pivotally attached thereto by pivot joints, whereby said at least one armrest, when said chair is folded to a collapsed position, also folds to a collapsed position parallel to said seatback.

14. The combination wheelchair and lift according to claim 11, further comprising fender means for guiding said combination wheelchair and lift past environmental obstructions which would otherwise snag thereon, whereby said combination wheelchair and lift is able to be pulled up a flight of stairs.

* * * * *